US012674296B2

(12) United States Patent
Hall

(10) Patent No.: US 12,674,296 B2
(45) Date of Patent: Jul. 7, 2026

(54) BUCKET FOR HANDLING GROUND MATERIAL

(71) Applicant: Austin Engineering Limited, Kewdale (AU)

(72) Inventor: Jamie Vincent Clarke Hall, Kalamunda (AU)

( * ) Notice: Subject to any disclaimer, the term of this patent is extended or adjusted under 35 U.S.C. 154(b) by 606 days.

(21) Appl. No.: 18/245,883

(22) PCT Filed: Sep. 17, 2021

(86) PCT No.: PCT/AU2021/051080
§ 371 (c)(1),
(2) Date: Mar. 17, 2023

(87) PCT Pub. No.: WO2022/056599
PCT Pub. Date: Mar. 24, 2022

(65) Prior Publication Data

US 2024/0011239 A1 Jan. 11, 2024

(30) Foreign Application Priority Data

| | | |
|---|---|---|
| Sep. 18, 2020 | (AU) | AU2020903358 |
| Dec. 24, 2020 | (AU) | AU2020904845 |
| Aug. 24, 2021 | (AU) | AU2021221476 |

(51) Int. Cl.
*E02F 3/40* (2006.01)

(52) U.S. Cl.
CPC ..... *E02F 3/40* (2013.01)

(58) Field of Classification Search
CPC . E02F 3/40; E02F 3/404; E02F 9/2883; E02F 3/401; E02F 3/60
See application file for complete search history.

(56) References Cited

U.S. PATENT DOCUMENTS

| | | | |
|---|---|---|---|
| 1,107,252 | A | 8/1914 | Black |
| 1,539,863 | A | 6/1925 | Louis |

(Continued)

FOREIGN PATENT DOCUMENTS

| | | | |
|---|---|---|---|
| AU | 2019100585 | A4 * | 7/2019 |
| CA | 2623512 | A1 | 9/2009 |

(Continued)

OTHER PUBLICATIONS

International Search Report and Written Opinion of the International Searching Authority; Application No. PCT/AU2021/051080; Issued: Oct. 18, 2021; 14 Pages.

*Primary Examiner* — Christopher J Sebesta
*Assistant Examiner* — Blake E Scoville
(74) *Attorney, Agent, or Firm* — Patrick D. Duplessis

(57) ABSTRACT

A bucket for moving ground material is disclosed comprising a handling section that is connected to a separate load carrying section to form a fixed body. The handling and load carrying sections define a load carrying space and forming a fixed open mouth through which material is received into and discharged from the load carrying space. The handling section includes an upper wall that extends in a direction away from a front end adjacent the open mouth to a rear end. The load carrying section includes a base wall and two side walls projecting up from each side of the base wall. The bucket includes a fastening arrangement fastening the handling section to the load carrying section. A method of changing the load carrying volume of a bucket and refurbishing a bucket by swapping out the load carrying sections is also disclosed.

20 Claims, 10 Drawing Sheets

(56) References Cited

U.S. PATENT DOCUMENTS

| | | | | |
|---|---|---|---|---|
| 2,336,749 | A | 12/1943 | Ratkowski | |
| 2,584,416 | A | 2/1952 | Boehringer | |
| 2,926,800 | A | 3/1960 | Larsen et al. | |
| 4,566,844 | A * | 1/1986 | Campin | E02F 3/404 37/409 |
| 4,633,601 | A * | 1/1987 | Fleck | E02F 3/404 37/444 |
| 4,939,855 | A | 7/1990 | Mccreary, Jr. | |
| 5,016,365 | A | 5/1991 | Robinson | |
| 5,084,990 | A | 2/1992 | Briscoe | |
| 5,261,170 | A | 11/1993 | Ward | |
| 5,743,030 | A * | 4/1998 | Sirr | E02F 7/06 37/444 |
| 7,789,613 | B1 * | 9/2010 | Weinlader | E02F 3/4075 37/409 |
| 9,903,092 | B2 * | 2/2018 | Lunn | E02F 9/2808 |
| 9,995,015 | B2 * | 6/2018 | Beckmann | E02F 3/40 |
| 2006/0182590 | A1 | 8/2006 | Mcfarland | |
| 2014/0230293 | A1 | 8/2014 | Lunn et al. | |
| 2016/0273185 | A1 | 9/2016 | Chabura et al. | |
| 2017/0167108 | A1 * | 6/2017 | Beckmann | E02F 3/40 |

FOREIGN PATENT DOCUMENTS

| | | | | |
|---|---|---|---|---|
| CN | 103097615 | A | 5/2013 | |
| CN | 205742310 | U | 11/2016 | |
| FR | 2939160 | A1 | 6/2010 | |
| GB | 2574444 | A | 12/2019 | |
| JP | 2002294739 | A | 10/2002 | |
| JP | S5625526 | B2 | 11/2014 | |
| KR | 101366614 | B1 | 2/2014 | |
| RU | 2431020 | C1 | 10/2011 | |
| WO | 9005813 | A1 | 5/1990 | |
| WO | WO-2007098542 | A1 * | 9/2007 | E02F 3/40 |
| WO | 2011011825 | A1 | 2/2011 | |
| WO | 2015077735 | A1 | 5/2015 | |
| WO | 2021014164 | A1 | 1/2021 | |

* cited by examiner

BUCKET FOR HANDLING GROUND MATERIAL

TECHNICAL FIELD

This disclosure relates to a bucket for moving ground. It also extends to a ground moving machine including the bucket. It also extends to a method of changing the size of a bucket and a method of refurbishing a bucket. This disclosure relates particularly but not exclusively to a bucket for a loader, and a wheeled loader having a bucket mounted on arms extending forward from the loader, e.g., a surface or above ground LHD loader. It will therefore be convenient to describe the invention hereinafter with reference to this example application. However, at the same time, it is to be clearly understood that the invention is capable of broader application. For example, it could be applied to other buckets and other ground moving machines.

BACKGROUND

In the specification and claims, the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

In the specification and claims, the term "ground material" shall be interpreted broadly and shall be understood to include all broken material that comes from or is extracted from the ground including rock, sand, earth, and ore material.

Earth or ground moving machines have wide application in construction, mining and engineering industries. Such ground moving machines include excavators, bulldozers, and loaders.

These machines have a bucket which is used to gather ground material, move the ground material and then discharge it in a different location. For example, loaders are used in mining operations to transfer ground material from a muck pile or heap of broken rock material to a dump truck. The loose ground materials include rock, and minerals such as iron ore and coal.

One prior art bucket is integrally formed and has an upper region that interacts with a bucket handling arrangement and a lower region that receives and holds the ground material loaded into the bucket. The lower region of an earth or ground moving bucket is subjected to high levels of wear and tear during daily operation of the bucket. By contrast, the upper region is exposed to significantly lower levels of wear in use, and the lifetime of the bucket is therefore determined by the longevity of the lower load carrying region.

One of the limitations with these buckets is that when the lower region is damaged or worn, the entire bucket needs to be replaced even though the upper region is still in a serviceable condition when this occurs. There is substantial cost in replacing an entire bucket because of the high cost of fabricating the bucket and machining some of the formations on the bucket, e.g., the high tolerance formations that interact with an external bucket handling arrangement.

Additionally, when a bucket fails and needs to be replaced, an associated loader may be out of commission for some time, and this results in a loss of revenue. Accordingly, machine operators would like to replace a failed bucket as quickly as possible.

The reference to prior art in the background is not and should not be taken as an acknowledgment or any form of suggestion that the referenced prior art forms part of the common general knowledge in Australia or in any other country.

SUMMARY

Applicant recognizes that it would be advantageous if at least some components of a bucket could be re-used if a bucket failed and required replacement. Yet further, Applicant recognizes it would be beneficial if a bucket could be refurbished quickly and easily if it was damaged, to limit the downtime of the machine on which the bucket was being used. Applicant also recognizes it would be beneficial if it was possible to change the size of a bucket and that this would help to optimize mining operations.

According to one aspect of the invention there is provided a bucket for a loader used in mining operations, the bucket comprising:

- a handling section that is connected to a separate load carrying section to form a fixed body, the handling and load carrying sections defining a load carrying space and an open mouth through which material is received into and discharged from the load carrying space,
- the handling section includes an upper wall that extends in a direction away from a front end adjacent the open mouth to a rear end, and the load carrying section includes a base wall and two side walls projecting up from each side of the base wall, and
- a fastening arrangement fastening the handling section to the load carrying section.

The handling section may include a mounting formation, and the load carrying section may include a complementary mounting formation interacting with said one mounting formation.

The load carrying section may be sized and configured to be received within the handling section with a small clearance. The upper wall of the handling section has two sides, and the sides of the upper wall may be positioned laterally outward of the side walls of the load carrying section.

The mounting formation may include locating elements on sides of the upper wall that locate the load carrying section on the handling section in a lateral direction.

The rear end of the upper wall of the handling section may slide over the rear end of the base wall outside of the base wall. The handling section may include locating formations, e.g., locating tabs on the upper wall, for locating the rear end of the base wall in position relative to the upper wall.

The fastening arrangement may comprise a primary side fastening arrangement fastening the side walls to the upper wall, and a secondary end fastening arrangement fastening the rear end of the upper wall to the base wall.

The primary side fastening arrangement may include a mechanical fastening arrangement comprising a pin on each side of the body operatively engaged with the side wall and the upper wall that supports the load carrying section on the handling section while permitting the handling section to pivot relative to the load carrying section. Each pin may be passed through aligned apertures formed in the side wall and upper wall respectively. The upper wall may include two spaced elements each defining a pin aperture therein and the side wall includes a further element defining a pin aperture therein, and the side wall may be sandwiched between the two spaced elements on the upper wall, with the pin being passed through all three apertures to support the load carrying section.

The secondary end fastening arrangement may include a plurality of mechanical fastening elements that fasten the rear end of the upper wall to the base wall.

The plurality of mechanical fastening elements may be spaced apart in a line from one side of the upper wall to the other adjacent to the rear end.

Instead of the fastening arrangement described above, the secondary end fastening arrangement includes at least one weld for welding the rear end of the upper wall to the base wall. The at least one weld may comprise two parallel extending weld lines that extend across the upper wall at the rear end. Yet further instead, the secondary end fastening arrangement may include a combination of welding and mechanical fastening elements.

Yet further, the primary side fastening arrangement may include at least one weld on each side of the upper wall for welding the upper wall to the side walls. The at least one weld may comprise two parallel extending weld lines that extend along each side wall welding the sides of the upper wall to the load carrying section.

The mouth may have a width extending from one side wall to the other side wall and a height extending from the base wall to the upper wall at the mouth, and the width of the mouth may be greater than the height of the mouth. The mouth may face forward, i.e., away from the rear end of the upper wall when the bucket is resting on a support surface and when the bucket is engaging rock material in use. The mouth does not face upwardly when it is resting on a support surface.

The width of the mouth may be at least 20% greater than the height of the mouth, preferably at least 50% greater than the height, and even more preferably at least 80% greater than the height.

The secondary end fastening arrangement may be a different arrangement to the primary side fastening arrangement, e.g., using different components or technique of fastening to the side fastening arrangement.

According to another aspect of the invention there is provided a method of changing the size of a bucket of a loader used in mining operations comprising a handling section that is connected to a separate load carrying section to form a fixed body defining a load carrying space and an open mouth through which material is received into and discharged from the load carrying space, the handling section including an upper wall that extends in a direction away from a front end adjacent the open mouth to a rear end, and the load carrying section including a base wall and two side walls projecting up from each side of the base wall, the method comprising:

separating said one load carrying section from the handling section and replacing it with another load carrying section that is configured to be mounted on said handling section without modification of the handling section, wherein a volume of the load carrying space of the body formed by said other load carrying section and the handling section is different to the volume formed by said one load carrying section and the handling section.

The handling section may include a mounting formation and the load carrying section may include a complementary mounting formation interacting with said one mounting formation. Said complementary mounting formations of each of said one and other load carrying sections may be sized and configured so that they both fit on said one mounting formation on the handling section (and said one and other load carrying sections are interchangeable).

The one and other load carrying sections may be received within the handling section.

The bucket body may have a depth in a direction from the front end to the rear end of the upper wall, and changing the load carrying section may increase/decrease the depth of the bucket body to increase/decrease the volume of the load carrying space.

The bucket may include a fastening arrangement fastening the handling section to the load carrying section, and detaching said one load carrying section from the handling section may include removing the fastening arrangement.

Replacing said one load carrying section with another load carrying section may include attaching the handling section to said other load carrying section using the fastening arrangement.

The fastening arrangement may include a primary side fastening arrangement attaching the side walls to the upper wall of the handling section comprising mechanical fasteners, e.g., in the form of a pin on each side of the body.

The fastening arrangement may also include a secondary end fastening arrangement fixing the rear end of the upper wall to the base wall. The secondary end fastening arrangement may comprise a plurality of mechanical fasteners or at least one weld, or a combination of welds and mechanical fasteners, fastening the rear end of the upper wall to the base wall.

The bucket may include one or more of the optional features of the bucket defined in any preceding aspect of the invention.

According to yet another aspect of the invention there is provided a method of refurbishing a bucket comprising a handling section and a separate load carrying section fastened together by a fastening arrangement to form a fixed body defining a load carrying space and an open mouth through which material is received into and discharged from the load carrying space, the handling section including an upper wall that extends away from the open mouth to a rear end, and the load carrying section including a base wall and two side walls projecting up from each side of the base wall, the method comprising:

separating the handling and load carrying sections from each other by removing the fastening arrangement, bringing another load carrying section into position adjacent to said one handling section, fastening said other load carrying section to said one handling section with the fastening arrangement by fastening the side walls to the upper wall and fastening the rear end of the upper wall to the base wall.

Said removing the fastening arrangement may include cutting or unfastening mechanical fasteners from the handling and load carrying sections.

Said fastening said other load carrying section to said one handling section with the fastening arrangement may include fastening the side walls to the upper wall with mechanical fasteners, and fastening the rear end of the upper wall to the base wall with mechanical fasteners.

Instead, said removing the fastening arrangement may include cutting welds fastening the handling and load carrying sections to each other.

Further, said fastening said other load carrying section to said one handling section may include welding the side walls to the upper wall, and welding the rear end of the upper wall to the base wall.

The bucket may include one or more of the optional features of the bucket defined in any preceding aspect of the invention.

According to yet another aspect of the invention there is provided a loader for use in mining operations comprising a front body section, and a rear body section that can articulate relative to the front body section to manoeuvre the loader in use, a pair of arms extending forward from the front body section, and a bucket mounted on the pair of arms as defined in any one of the preceding aspects of the invention.

The loader may include a hinge connection intermediate the front and rear body sections that enables them to pivot relative to each other.

The loader may have wheels on the front and rear body sections for travelling across the ground, and the rear body section may include an operator's cabin and a drive arrangement for the loader.

The loader may be a wheeled LHD loader used in above ground mining operations.

The bucket may include one or more of the optional features of the bucket defined in any preceding aspect of the invention.

BRIEF DESCRIPTION OF THE DRAWINGS

A bucket and a machine that is a wheeled loader for use in surface mining operations in accordance with this disclosure may manifest itself in a variety of forms. It will be convenient to hereinafter describe several embodiments of the disclosure in detail with reference to the accompanying drawings. The purpose of providing this detailed description is to instruct persons having an interest in the subject matter of the invention how to carry the invention into practical effect. However, it is to be clearly understood that the specific nature of this detailed description does not supersede the generality of the preceding broad description. In the drawings.

DETAILED DESCRIPTION

Figure 1:
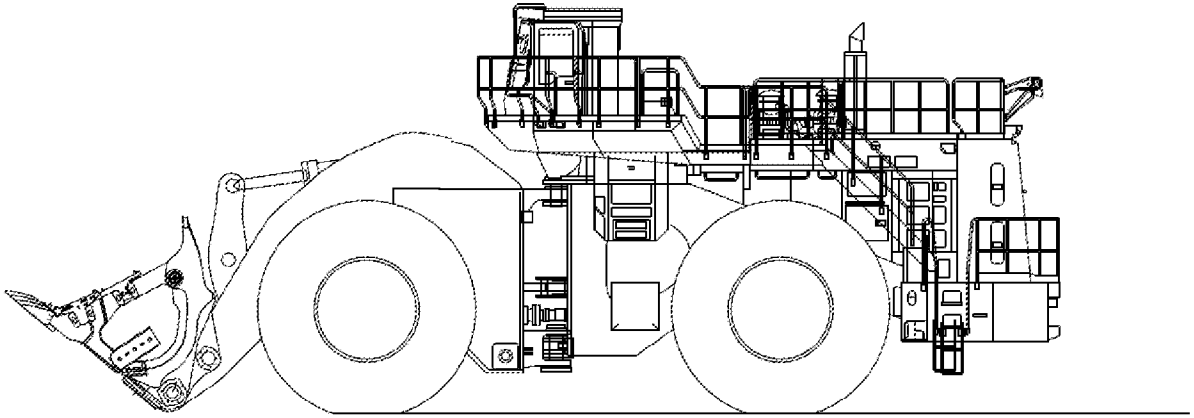
FIG. 1 is a schematic side view of a prior art wheeled surface loader for use in above ground operations.
Figure 2:
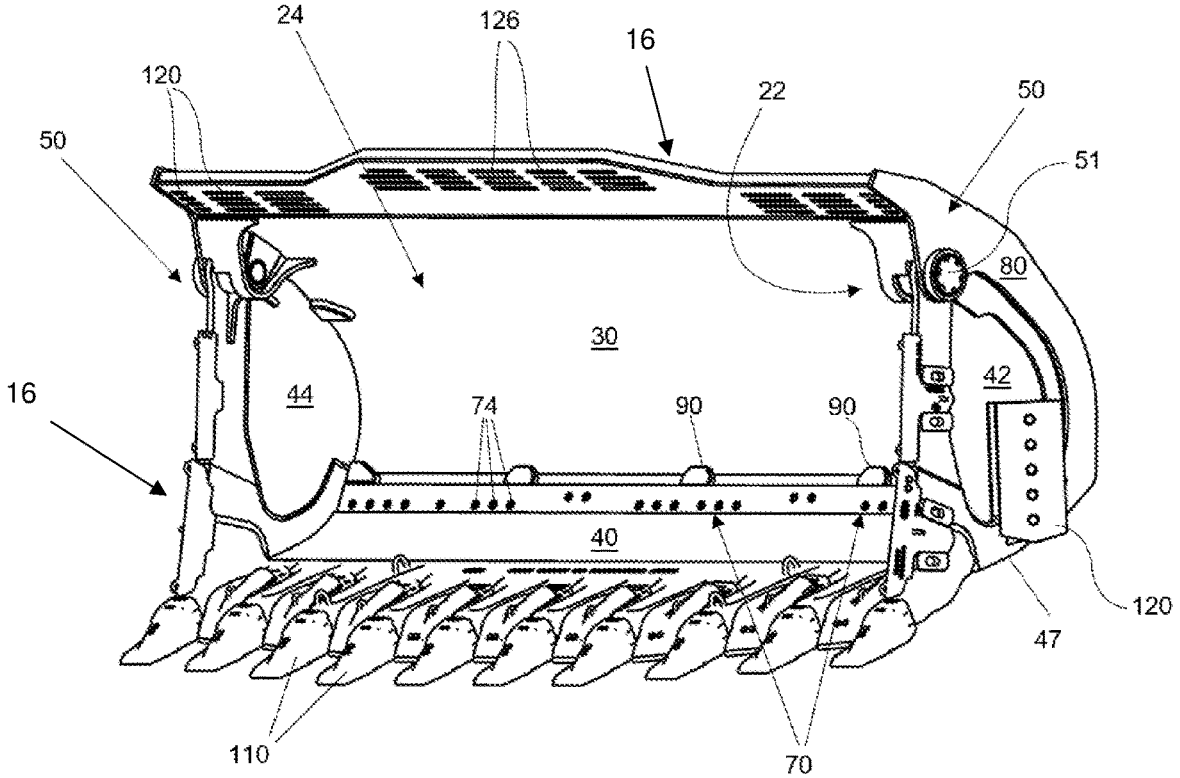
FIG. 2 is a front perspective view of a bucket in accordance with one embodiment of the invention for mounting on a wheeled loader.
Figure 3:
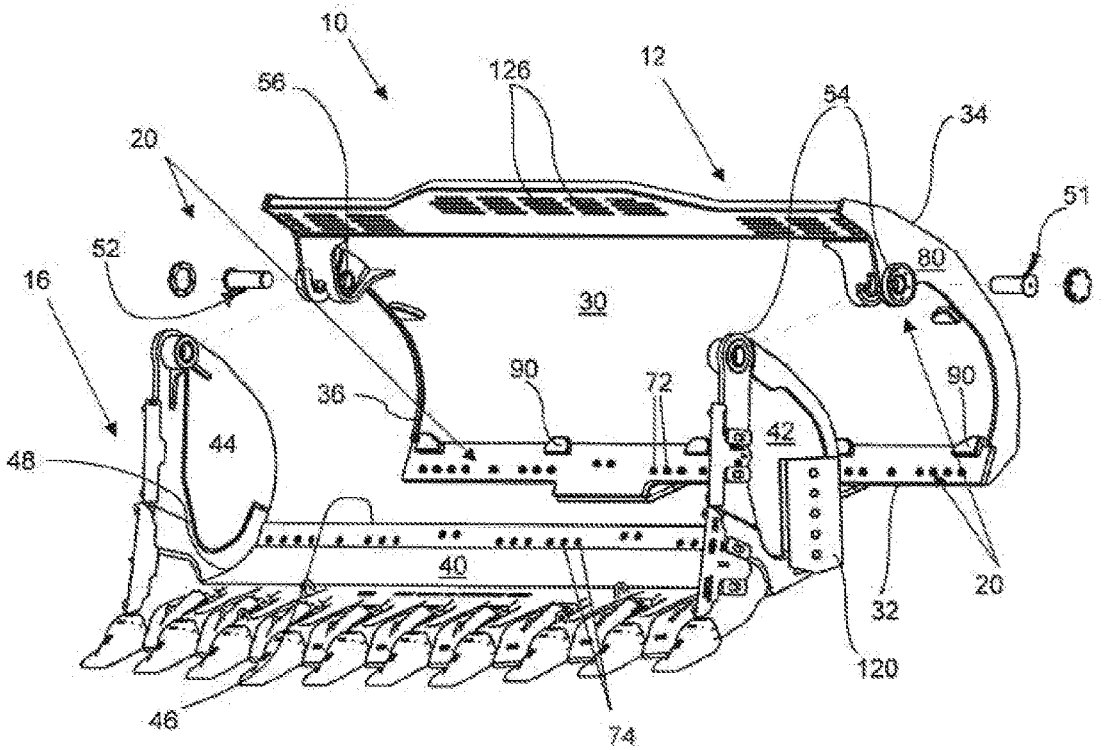
FIG. 3 is an exploded front perspective view of the bucket of FIG. 2.
Figure 4:
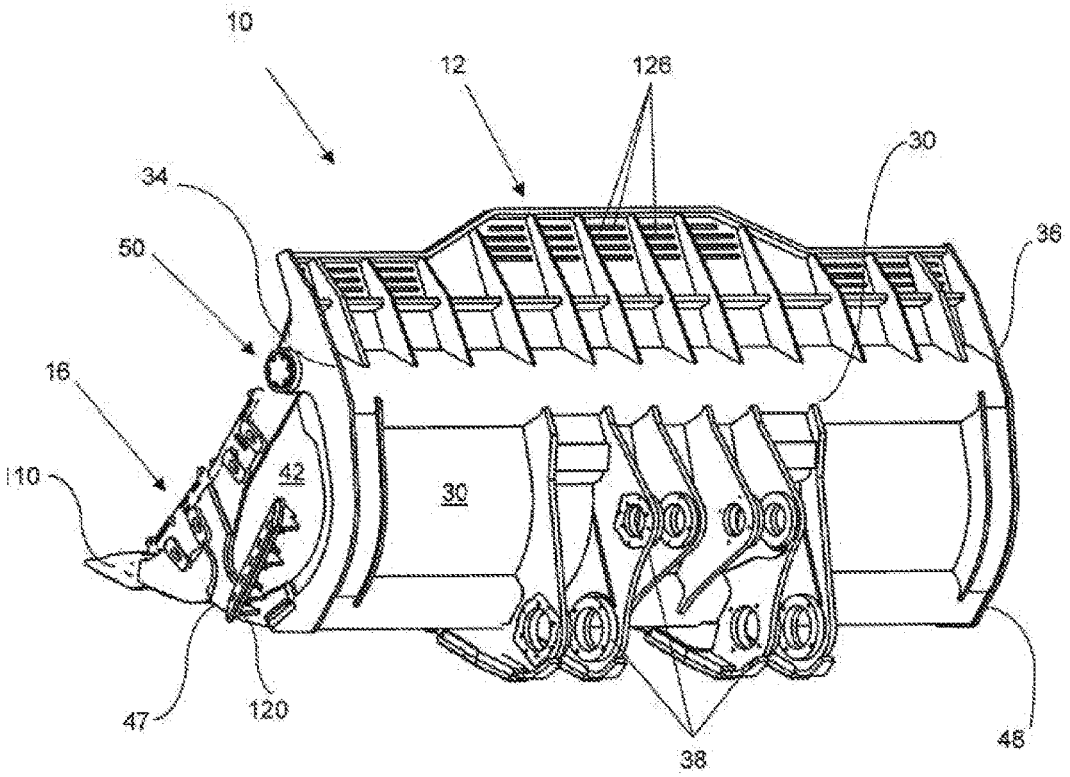
FIG. 4 is an upper rear perspective view of the bucket of FIG. 2.
Figure 5:
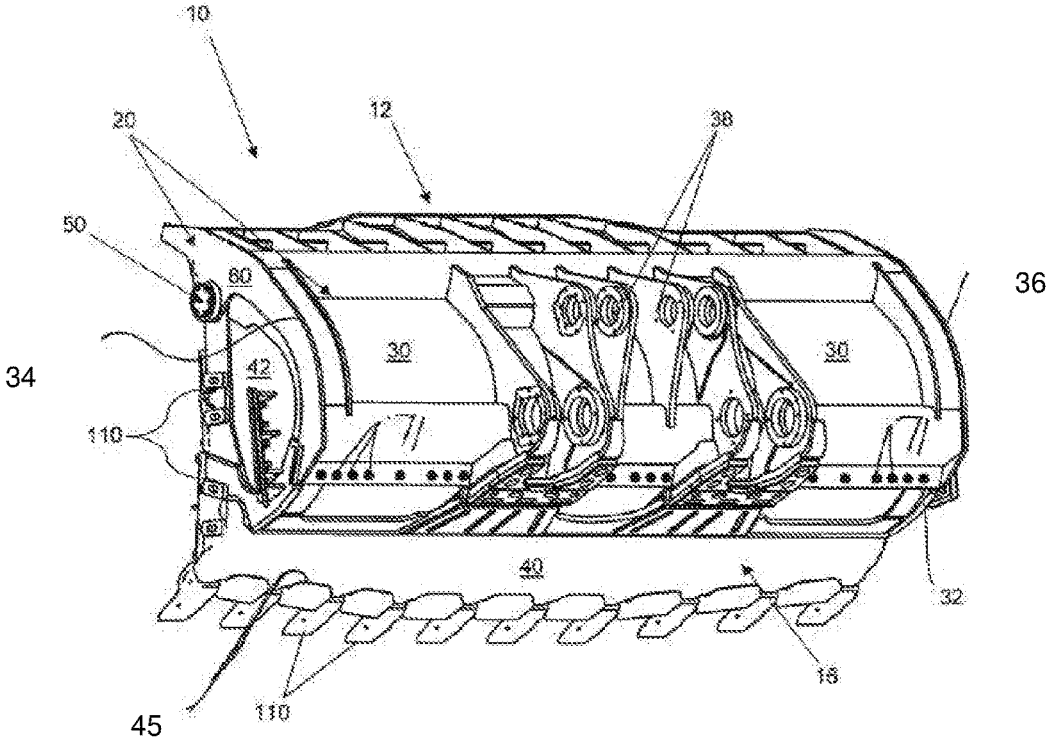
FIG. 5 is a lower rear perspective view of the bucket of FIG. 2.

FIG. 1 illustrates a wheeled loader of the general type known in the art. The wheeled loader has a vehicle body mounted on wheels and an operator's seat up on the vehicle body. The body comprises a front body section and an articulating rear body section, and a pair of arms projecting forward from the front body section with a bucket mounted on the ends of the arms. The loader further includes a bucket handling arrangement including one or more hydraulic systems for manoeuvring the bucket including lifting and tipping the bucket in use.

In FIGS. 2 to 5, reference numeral 10 refers to a loader bucket, e.g., an excavator or loader bucket, for moving ground material, e.g., broken rock and ore material, in accordance with the disclosure.

The bucket 10 comprises broadly a handling section 12 that is rigidly connected to a separate load carrying section 16 by means of a fastening arrangement indicated generally by reference numeral 20 to form a fixed body. The handling and load carrying sections 12 and 16 define an interior load carrying space 22 having a volume and form a fixed open mouth 24 through which material is received into the load carrying space 22 and through which material is discharged from the load carrying space 22.

The handling section 12 includes an upper wall 30 that curves down in a direction away from the open mouth 24 along its length to a remote or rear end 32 that abuts the load carrying section 16. The curved upper wall has two sides 34 and 36 extending from the mouth 24 to the rear end 32.

The handling section 12 also includes a bucket handling formation 38 which is coupled to and interacts with an external bucket handling arrangement (not shown in FIGS. 2 to 5 but shown in FIG. 1) to operate and manoeuvre the bucket 10. In particular, the external bucket handling arrangement 38 is used for moving the bucket 10 between a loading position for receiving material and an inverted discharge position for discharging material from the bucket 10.

The load carrying section 16 includes a base wall 40 and two side walls 42 and 44 extending up from the base wall 40. The two side walls 42 and 44 have an upper edge 46 that abuts against the sides 34 and 36 of the upper wall 30. The base wall 40 has a front or mouth end 45 and a rear end 46 and two sides 47 and 48 extending between the mouth end 45 and rear end 46.

The fastening arrangement 20 in turn includes a primary side fastening arrangement 50 and a secondary end fastening arrangement 70. The primary side fastening arrangement 50 fastens each side of the handling section 12 to the associated side wall of the load carrying section 16. By comparison, the secondary end fastening arrangement 70 attaches the rear end 32 of the upper wall 30 of the handling section 12 to the rear end 46 of the base wall 40 of the section 16. The primary and secondary fastening arrangements 50 and 70 are different from each other and they will therefore be described separately in some detail below.

In the illustrated embodiment, each primary side fastening arrangement 50 comprises a primary fastener or pin 51 or 52, on each side of the body, extending through complementary aligned fastener apertures 54 or 56 in the handling and load carrying sections 12 and 16 respectively. The primary fasteners 51 and 52 are located adjacent to the open mouth 24 towards an upper end of the side walls 42 or 44. This secures the section 16 to the section 12 adjacent the mouth which is subject to a high load in use.

Figure 7:
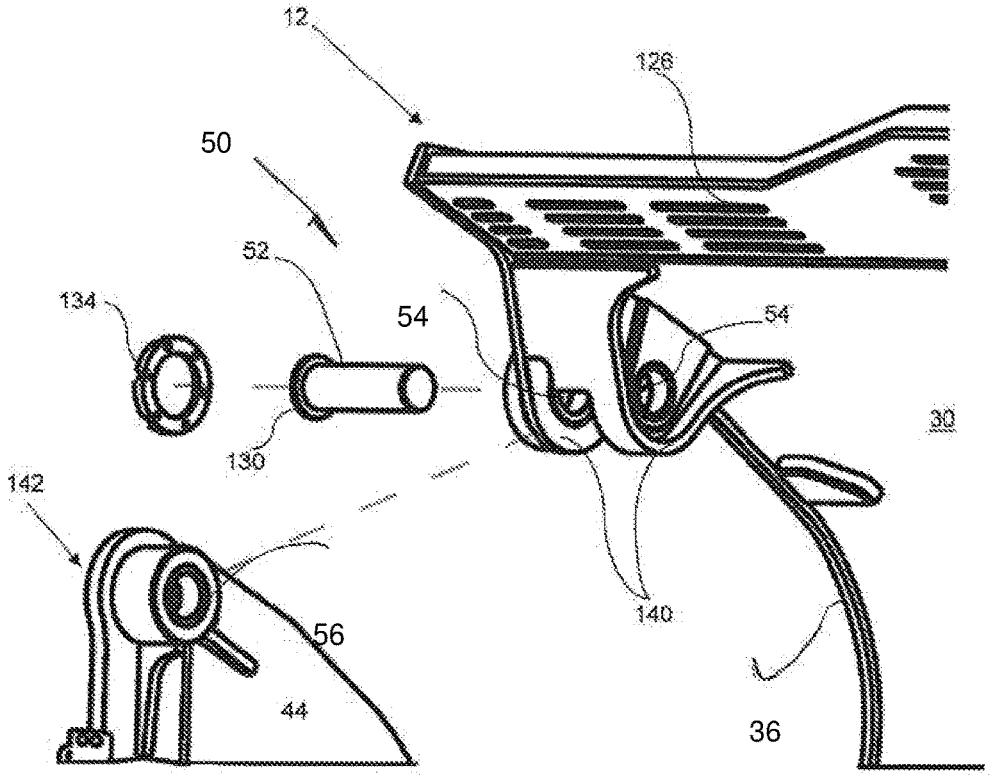
FIG. 7 is an exploded perspective view showing the primary side fastening arrangement in FIG. 6 together with part of a handling section and an associated side of a load carrying section.
Figure 8:
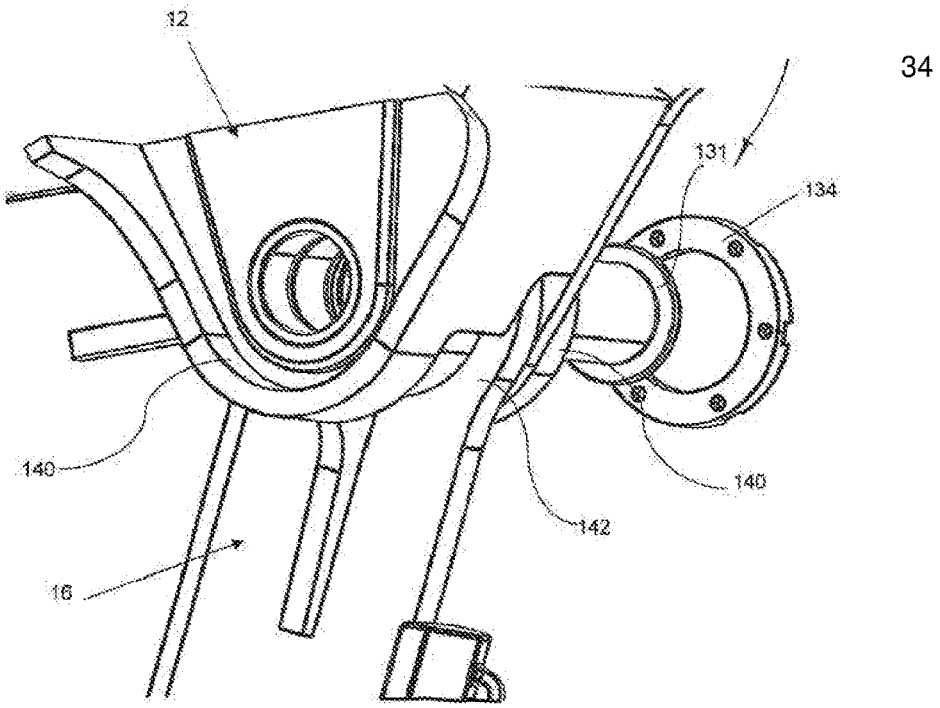
FIG. 8 is an assembled perspective view of the primary side fastening arrangement in FIG. 6 with part of the handling section and the load carrying section.

As shown in FIG. 7, the primary side fastening arrangement includes boss formations indicated by numerals 140, 142 that are formed on respectively the handling and load carrying sections 12 and 16. The boss formations 140, 142 form the primary fastening apertures 54, 56 that receive the primary fasteners 51, 52. FIG. 8 shows the same structures as FIG. 7 but with the primary side fastening assembly 50 shown from a different angle.

The boss formation 140 on the handling section 12, for example, has two elements or walls that are spaced apart from each other, that each define a primary side fastening aperture 54 or 56 through which the fastening member 51 or 52 is passed. By contrast, the boss formation 142 on the load carrying section 16 has a single element or wall with its side fastening aperture that is received between or sandwiched between the two walls of the boss formation 140 of the handling section 12.

Additionally, the primary fasteners 51 and 52 are able to rotate to some extent within the primary side fastening apertures 54 and 56 and this enables the handling section 12 to pivot relative to the load carrying section 16. This enables the handling section 12 to be pivoted down into engagement with the load carrying section 16 during assembly of the bucket 10 as will be described in more detail below.

Figure 6:
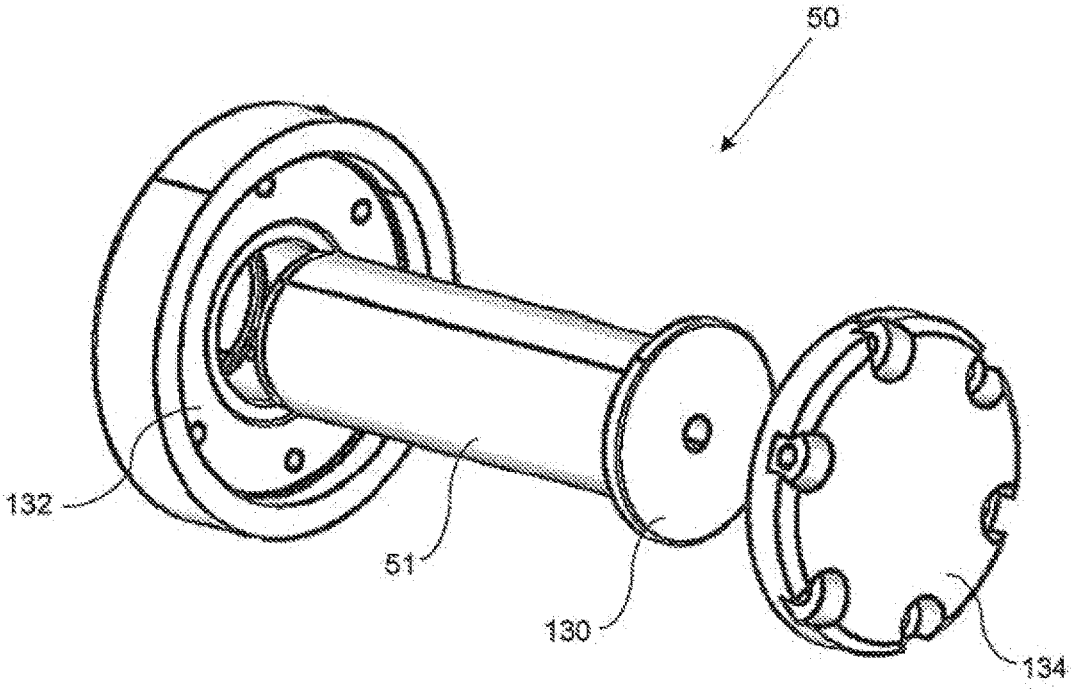
FIG. 6 is an exploded perspective view of a part of the primary side fastening arrangement with a pin for the bucket of FIG. 2.

FIGS. 6 to 8 illustrate the primary side fastening arrangement 50 in more detail. However, this is merely one example embodiment that has been used by the applicant in putting this invention into practice, and there are many other ways in which this general principle could be implemented. Therefore, it must be understood that it does not limit the scope of this disclosure in any way.

Each primary fastener 51 and 52 is a reusable pin having a diameter of about 40-150 mm (illustrated in FIG. 6). The pin has a head 130 outside the upper wall 30 and the side wall 42 or 44. A removable retainer or cap 134 is mounted on the head 130 of the pin outside the upper wall 30 to resist it from being removed from the sections 12 and 16. The pin is sized and engineered to withstand loads of the size that would be encountered when the bucket 10 is filled with broken rock material. The pin has an end opposite to the head 130 which is received within a tight or snug passage 132 on the boss of the handling section 12.

The plurality of secondary end fasteners 71 connect the upper wall 30 of the handling section 12 to the base wall 40 of the load carrying section 16. The secondary end fasteners 71 are arranged in a line from one side of the upper wall 30 (and base wall 40) to the other side, at the rear ends 46 and 32 thereof remote from the mouth 24. In the illustrated embodiment, the bucket 10 has about 16-24 end fasteners 71 securely fastening the base wall 40 to the upper wall 30. However, it must be understood that the number of fasteners 71 extending across the upper wall will depend in large measure on the size of the bucket and can therefore vary quite considerably for different sizes.

The secondary end fasteners 70 include complementary end fastener apertures 72 and 74 defined in respectively the upper wall 30 of the handling section 12 and the base wall 40 of the load carrying section 16. When the sections 12 and 16 are engaged to form a bucket 10, the corresponding secondary apertures 72 and 74 are aligned with each other and each secondary end fastener 71 is passed through an aligned pair of apertures 72, 74.

The handling section 12 includes a mounting formation and the load carrying section 16 has a complementary mounting formation that interacts with said one mounting formation by being received within said one mounting formation. The mounting formation includes a transverse flange 80 that depends down from both sides 34, 36 of the upper wall 30 perpendicular to the upper wall 30. The flange 80 on the left side of the bucket is clearly shown in FIGS. 2 and 3 and there is a similar flange on the right side of the bucket 10. The flanges are positioned laterally outward of the side walls 42, 44 of the load carrying section 16 which is effectively received within the handling section 12.

The transverse flange 80 extends down over its adjacent side wall 42 and provides mechanical support for the handling section 12 around the boss formations 140 and associated fastener apertures 54 and 56. It will be appreciated that a substantial load is applied through the pins 51, 52 to the handling section 12 around the apertures 54 and 56.

The walls or elements with their fastener apertures 54 or 56 in the handling and load carrying sections 12 and 16 (with the wall of the load carrying section sandwiched between the spaced walls of the handling section) help to position the load carrying section 16 accurately with respect to the handling section 12. In particular, these walls position the sections 12 and 16 correctly relative to each other in a direction of width.

The bucket 10 also includes locating tabs 90 on the handling section 12. These locating tabs 90 assist in locating a new load carrying section 16 in position within the existing handling section 12 particularly in a front to rear direction. In particular, the tabs help to locate the rear end of the base wall in position relative to the upper wall. In the illustrated embodiment, these locating tabs 90 comprise blocks or buttress formations welded onto the upper wall 30 that are spaced apart across the width of the upper wall 30 of the section 12. The bucket includes further tabs adjacent the sides of the handling section 12 for locating the side walls of the load carrying section 16 against the handling section 12.

During assembly of a bucket 10, the base wall 40 of the section 16 is received within the rear end 32 of the upper wall 30 of the section 12 and is displaced or slide across an inner surface of the upper wall 30 until the rear end 46 of the base wall 40 butts up against the locating tabs 90 on the handling section 12.

The locating tabs 90 are positioned such that when the rear end 46 of the base wall 40 abuts the formations 90, the sections 12 and 16 are aligned with each other in a front to rear direction. In this position, the secondary end fastener apertures 72 and 74, are also aligned with each other in a front to rear direction. Further, locating tabs towards the sides of the upper wall help to align the apertures 72 and 74 in a transverse direction.

The bucket further includes GET (ground engaging teeth) formations 110 extending around the open mouth 24 for enhancing the wear protection of this high wear region of the bucket 10. The GET formations 110 typically comprise discrete teeth that are individually mounted on the mouth end 45 of the base wall 40 of the load carrying section 16. The GET formations 110 may also include folded plates that are mounted over a leading edge of the side walls 42 and 44. The structure and function of GET formations 110 is known in the prior art and does not form part of the invention disclosed in this application. They will therefore not be disclosed in further detail in this detailed description.

Additionally, the bucket 10 includes deflector plates 120 mounted on an outer surface of each side wall 42, 44 of the load carrying section 16. The deflector plates 120 flare outward away from the side wall 42 or 44 in a direction away from the mouth 24. The deflector plates 120 function to deflect broken rock material away from the wheels of the loader vehicle in use. As these deflector plates 120 are known in prior art loaders, they will not be described in greater detail in this specification.

Further, the upper wall 30 of the handling section 16 has an arrangement of elongate slots 126 defined therein towards the mouth 24 or leading end thereof proximate to the mouth 24. These slots 126 in the upper wall 30 increase the visibility of the ground in front of the bucket 10 for a driver or operator of the loader. Once again, as these elongate slots 126 are known in the art they will not be described in further detail in this detailed description.

In use, a new bucket 10 of the type described above with reference to FIGS. 2 to 8, will typically be supplied out of a workshop to a loader operator for use on a surface loader that is similar to that shown in FIG. 1. The handling and load carrying sections 12 and 16 are operatively connected to each other by means of the mechanical fastening arrangement 20 to form a single bucket body that is ready for use. The bucket 10 can be mounted on an external bucket handling arrangement of the loader by means of the handling formation 38 and the loader is then ready for use. During operation, the bucket 10 is used to pick up and move broken rock and ore material, e.g., generated in mining operations. By way of example, the loader may be used to collect material from a muck pile after blasting and deposit it in an ore carrying truck which then carries the material away from the muck pile.

The bucket 10 is exposed to a harsh environment in mining operations which subjects it to high wear. After a period of use, the load carrying section 16 will become worn and/or damaged to the point where the bucket 10 cannot perform its function and the section 16 needs to be replaced.

To do this, the bucket 10, and specifically the handling formation 38 of section 12, may be first detached or removed from the external bucket handling arrangement or arms of the loader to which it is fitted. This therefore basically removes the bucket from the loader on which it is mounted. This would typically be the case where a bucket is damaged and requires complete refurbishment.

Thereafter, the load carrying section 16 is separated or detached from the handling section 12 by releasing and/or removing the fasteners of the mechanical fastening arrangement 20. This involves firstly removing the secondary fasteners 71 extending along the width of the base wall 40. This is done manually by a technician using appropriate tools for the type of fasteners being used as the secondary fasteners. Where the fasteners 71 are nut and bolt fasteners, the nuts can be removed enabling the bolts to be withdrawn from their fastener apertures. Depending on their condition, the fasteners 71 are either re-used to fasten the new load carrying section or they are thrown away and replaced with new fasteners.

After the secondary fasteners 71 have been removed, the primary fasteners that are the pins 51 and 52 are removed from the primary side fastener openings 54, 56 in the boss formations 140, 142 of the handling and load carrying sections 12 and 16. This is done by removing the cap retainers 134 from the fastening members 51, 52 and then withdrawing the fasteners 51 and 52 from their side fastener apertures 54 and 56.

Once this has been done, the sections 12 and 16 are effectively detached, and the handling section 12 can be lifted off the old worn load carrying section 16 and replaced with a new load carrying section 16.

When assembling or mounting the new load carrying section 16 on the handling section 12, the various fastener apertures 54 and 56 and 72 and 74 need to be registered with each other, i.e., be aligned with each other. However, it is not a straightforward task to align or register all the associated fastener apertures with each other because the harsh operating environment causes some deformation of the bucket in use. In addition to wear of the load carrying section 16, the handling section 12 may also be deformed even though it has less contact with the rocks and other ground material than the load carrying section 16.

In a first step, the boss formations 142 on section 16 are received between the boss formations 140 on the section 12. This correctly positions the handling section 12 relative to the side walls 42, 44 of section 16 in a direction of width, i.e., extending from one side wall to the other side wall.

The primary side fastening members 51, 52 are then passed through their associated side fastener apertures 54, 56 in the sections 12 and 16 providing a basic attachment of the sections 12 and 16. The sections 12 and 16 are then aligned with each other in a transverse direction but can pivot relative to each other in a front to rear direction. That is, the primary side fastening members 51, 52 can rotate within the primary side fastening apertures 54, 56.

Thereafter, the sections 12 and 16 need to be brought into their assembly position in a front to rear direction. To do this, the handling section 12 is pivoted down into its assembly position on the load carrying section 16. The handling section 12 is correctly located in position when the rear end 46 of the base wall 40 of the load carrying section 16 butts up against the locating tabs 90 on the upper wall 30.

This action registers the associated pairs of secondary end fastener apertures 72 and 74 of two sections 12 and 16 in a front to rear direction. This enables the secondary end fasteners 71 to be inserted through the associated pairs of end apertures 72, 74 to secure the new section 16 to the existing section 12. After this has been done, the bucket 10 is ready for use and can be operatively mounted on the external bucket handling arrangement of the loader.

An advantage of the embodiments illustrated in FIGS. 2 to 8 is that a worn load carrying section can be changed quite easily and quickly at a mine site, e.g., an open cut mine. The fastening arrangement can be mechanically removed to separate the old load carrying section 16 from the handling section 12 using basic tools because the sections are not welded together. This obviates the need for cutting torches and welding apparatus which would require different trades to be used and entail additional cost.

The combination of primary side fastening arrangements and secondary end fastening arrangements helps to facilitate appropriate mechanical attachment and connection of the handling and load carrying sections with limited equipment. This embodiment helps to facilitate attachment of a new load carrying section to an existing handling section even if it has been deformed to some extent.

Further, the primary side fastening arrangement comprising the pins passed through the apertures on the sides of the sections 12 and 16 considerably simplifies the fastening arrangement and makes it more user friendly that prior techniques. Yet another advantage of the working embodiment in FIGS. 2 to 8 above is that it facilitates alignment of the secondary end fastening apertures to enable the secondary end fasteners to be passed through the apertures without the need for redrilling. This helps to reduce the change time for swapping out load carrying sections.

While the process of swapping out load carrying sections can technically be performed in the field, more typically mine managers insist that it be done in a workshop for workplace safety reasons. In some applications where there is a simple swap out of load carrying sections, to change the load carrying volume of the bucket and no refurbishment is required, the bucket may remain operatively connected to the loader while the load carrying section is replaced.

One advantage of all illustrated embodiments of the bucket is that when a lower load carrying section of a bucket fails or is damaged, it can be removed and replaced with a new load carrying section. The handling section is re-used, and this is advantageous because the handling formation that interacts with the external controls is machined to a high tolerance and is expensive to manufacture.

Yet another advantage of all illustrated embodiments is that the handling section comprises a curved upper wall which extends rearward from the mouth to the load carrying section. Further, the load carrying section comprises a substantially planar base wall that matches the upper wall of the handling section and two substantially planar side walls extending up from the base that close off sides of the bucket. This basic structure assists with fabrication of the handling and load carrying sections.

Another advantage of all the described embodiments of a two-piece bucket is that a fabrication of separate handling and load carrying sections takes up less workshop space. Further, the separate sections are smaller and some 'working at height' risks are removed improving safety.

Related to this, the fabricated sections can be handled separately post manufacture which is easier because the sections are smaller than a combined bucket. A large bucket can be expensive to transport from its manufacturing site to a mine site and it can be cheaper and easier to transport two smaller components to site. By separately manufacturing the handling and load carrying sections, the sections can be packed more efficiently, e.g., 'flat packed' for shipping to the customer which reduces shipping costs. The difficulty of transporting large unitary buckets to remote customers in overseas countries adds significant cost and in some extreme cases can result in lost sales.

FIGS. 12 to 15 illustrate a bucket in accordance with another embodiment of the invention. In FIGS. 12 to 15, the same reference numerals will be used to refer to the same components unless otherwise illustrated. Further, the following description will focus on the difference between this embodiment and the embodiment described above with reference to FIGS. 2 to 5.

The bucket in FIGS. 12 to 15 has complementary engagement formations on respectively the handling and load carrying sections 12 and 16 that enable the sections 12 and 16 to fit together and have surfaces that engage with each other.

The handling section 12 has an engagement formation that comprises flanges 210 and 212 on the sides of the upper wall 30 that extend downward over complementary engagement formations on the load carrying section 16. In turn, the complementary engagement formations on the load carrying section 16 are formed by upper edge regions 216 and 218 of side walls 42 and 44 that extend up from the sides of the base wall 40. The side walls 42, 44 and particularly the upper edge regions 216 and 218 thereof, are received within the flanges 210 and 212 extending down from the upper wall 30. The flanges 210 and 212 are sized to receive the formations 216 and 218 therein with a small amount of clearance. That is, the load carrying section 16 is received within the handling section 12.

Further, the rear edge 32 of the upper wall 30 is positioned outside the base wall 40 of the section 16 (which is received within the upper wall), and the rear edge 46 of the base wall 40 is correctly located in position in a front to rear direction by locating formations 220 on the section 12.

Figure 12:
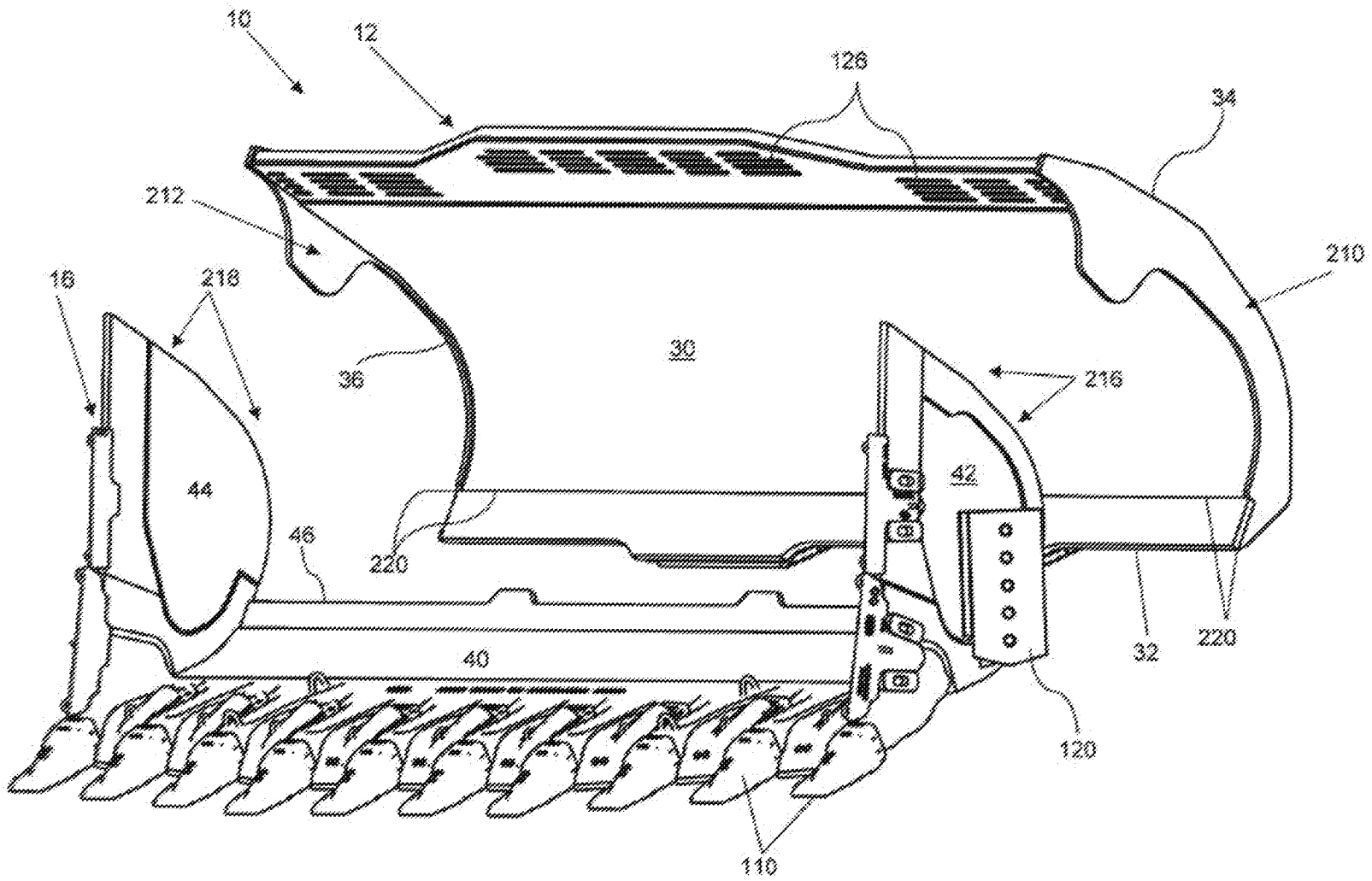
FIG. 12 is an exploded perspective view of a bucket in accordance with another embodiment of the invention for mounting on a wheeled loader.
Figure 13:
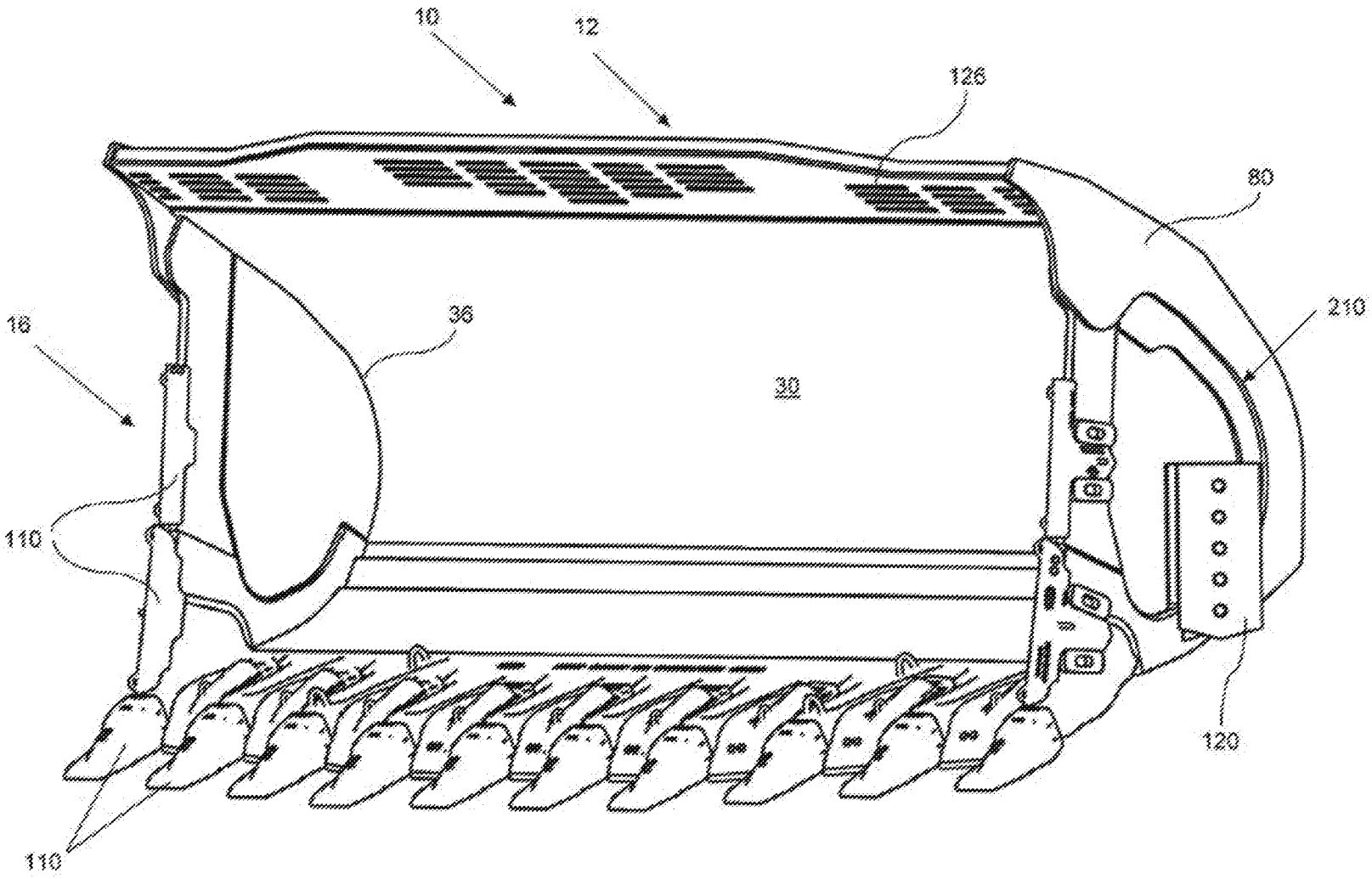
FIG. 13 is a perspective view of the bucket in FIG. 12 shown in an assembled condition.

In the FIG. 12 embodiment, the fastening arrangement on the bucket comprises a plurality of welds which weld the sections 12 and 16 together. More specifically, the complementary engagement formations on the handling and load carrying sections 12 and 16 are welded to each other.

Figure 14:
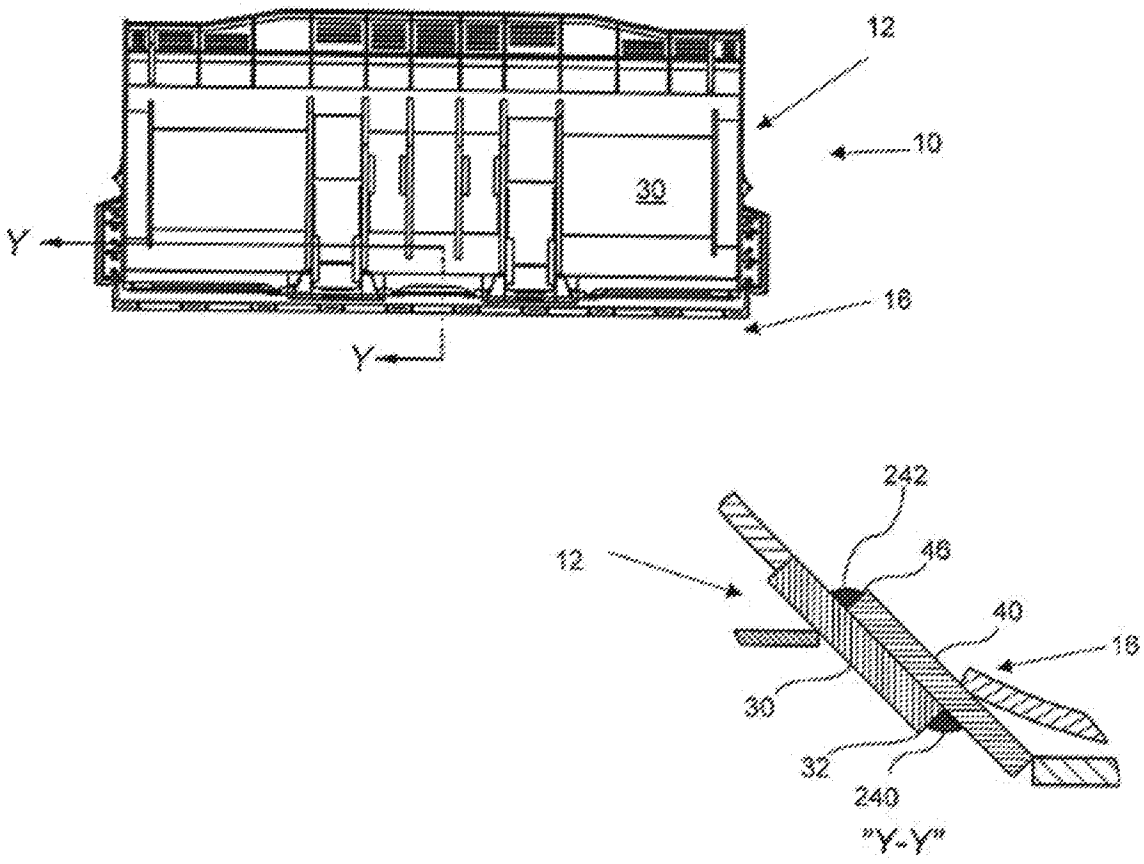
FIG. 14 is a rear view with a cross sectional view of the bucket of FIG. 12, section through Y-Y.

The section 12 is welded to the section 16 along each side 34 and 36 of the upper wall 30. As shown in FIG. 14 at a more detailed level, there are two weld lines 230, 232 along each side 34, 36 of the upper wall 30. One weld line 230 is located where the edge of the section 12 abuts against the side wall 42, 44 of the section 16. That is, where the terminal edge of the flanges 110, 112 abuts against the surface of the side wall 42 or 44. The other weld line 232 is located where the upper edge of the side walls 42, 44 abuts against the handling section 12. That is, where the terminal edge of the engagement formations formed by the upper edge regions 116 and 118 abuts up against the handling section 12.

Figure 15:
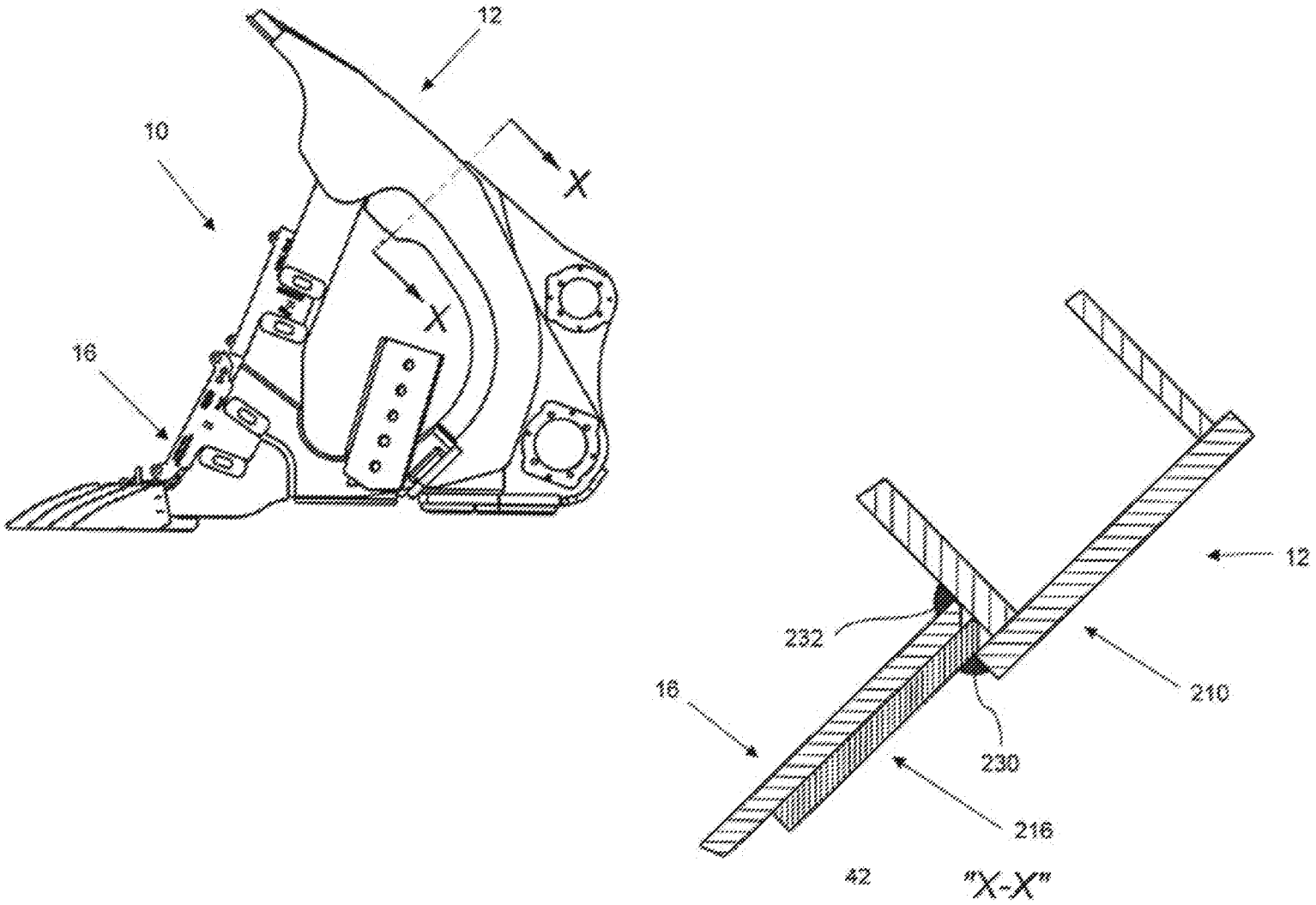
FIG. 15 is a front view with a sectional view of the bucket of FIG. 12, section through X-X.

Further, the section 12 is welded to the section 16 along the rear end 32 of the upper wall 30. As shown in FIG. 15 in the illustrated embodiment, there are two weld lines 240, 242 extending along the rear end 32 of the upper wall 30. One weld line 240 welds the terminal end 32 of the upper wall 30 to the adjacent surface of the base wall 40. Another weld line 242 welds the rear end 46 of the base wall 40 to the adjacent abutting surface of the upper wall 30.

In use, when an operator desires to replace an existing, e.g., worn, load carrying section 16 with a new load carrying section 16 they cut through the welds along the weld lines to detach or separate the section 16 from the section 12.

A new section 16 is then brought into position beneath the handling section 12 and the configurations of the sections 12, 16 with their complementary engagement formations 210, 212 and 216, 218 helps to locate them in a correct position relative to each other. The new section 16 is then welded to the existing handling section 12. This provides a bucket 10 with a new load carrying section 16 and a new working life.

Further, in another embodiment that is not illustrated in the drawings, the sections 12 and 16 of the new bucket 10 may be fastened to each other by means of a combination of mechanical fasteners and welds. For example, the side walls 42, 44 could be fastened to the upper wall 32 by mechanical fasteners like the primary side fasteners shown in FIGS. 2 to 5 and the rear ends 46 and 32 of the base wall 40 and the upper wall 32 could be welded to each other.

Instead, the side walls could be welded to the section 12 and the rear ends of the base wall and the upper wall could be fastened to each other by mechanical fasteners like the secondary fasteners shown in FIGS. 2 to 5. Further and different combinations of mechanical fasteners and welds could also be used to fasten the handling section to the load carrying section.

Figure 9:
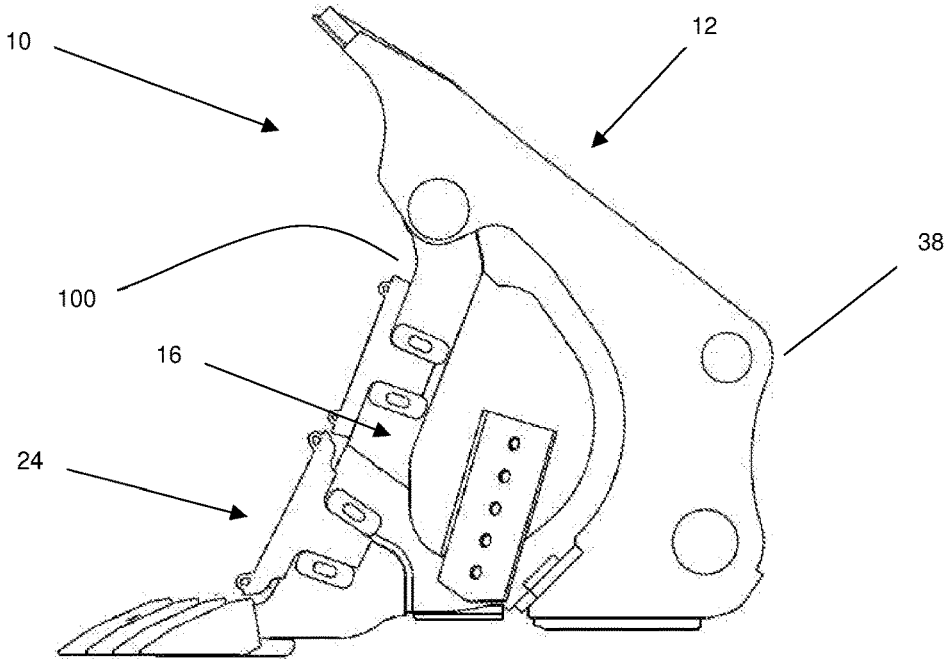
FIGS. 9 to 11 are side views of three buckets having different volumes of load carrying spaces in accordance with further embodiments of the invention.
Figure 10:
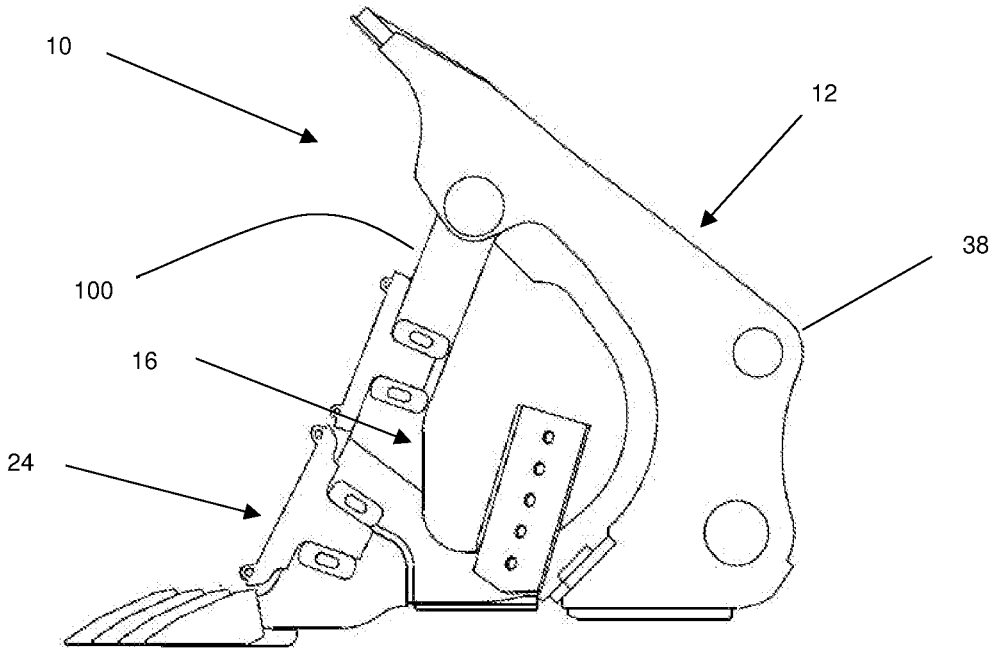
Figure 11:
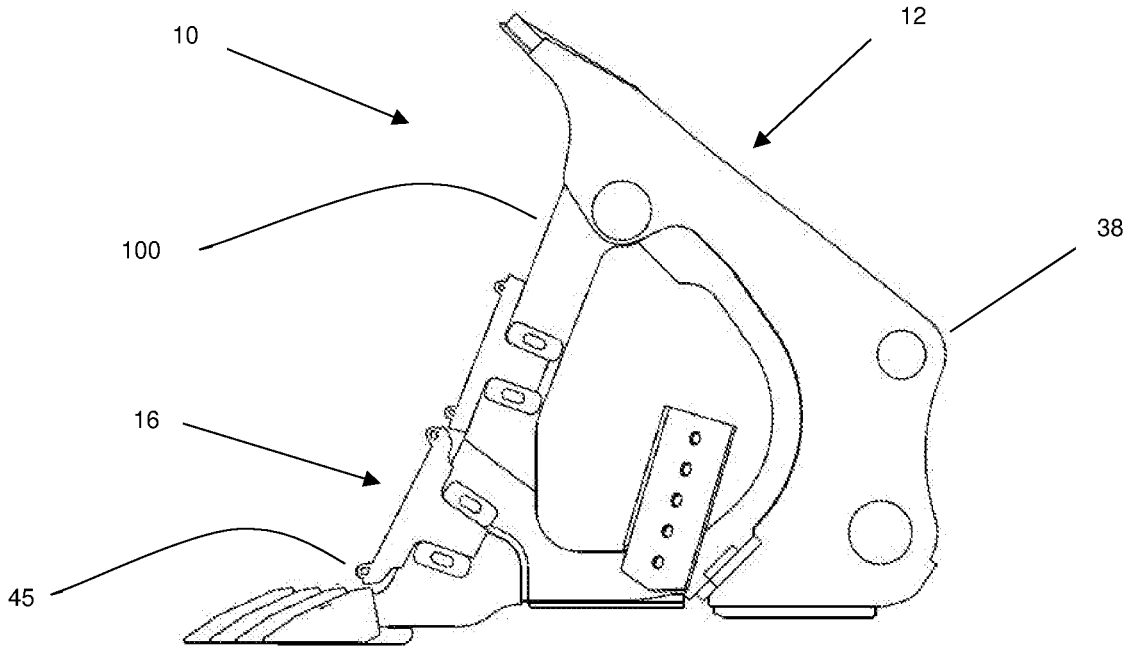

FIGS. 9 to 11 illustrate bucket which is structurally similar to the bucket shown in FIGS. 1 to 8. However, the volume of load carrying space in the bucket can be changed by swapping out one load carrying section for a different size of load carrying section.

FIG. 9 shows a bucket having a first volumetric capacity. As shown in the drawings, a leading edge 100 of the load carrying section 16 is set back from the primary attachment 50 or pin of the load carrying section 16 to the handling section 12. That is, it turns or bends towards the rear, e.g., of the upper and base walls, as it extends down away from the pin of the primary attachment 50.

FIG. 10, in turn, shows a bucket 10 which is very similar to that in FIG. 9 except that it defines a load carrying space 22 of larger volume than the bucket in FIG. 9. As shown in the drawings, the leading edge 100 of the load carrying section 16 extends in a line directly down or straight down from the primary side fastener or pin. It is therefore forward of the leading edge of the section 16 of the bucket 10 shown in FIG. 9. The depth of the bucket in FIG. 10 is greater than that in FIG. 9 and thus the bucket 10 defines a larger load carrying space 22.

FIG. 11 shows a bucket 10 that is very similar to the bucket in FIGS. 9 and 10 but defines a volumetric capacity that is larger than the bucket shown in either FIG. 9 or 10. In this case, the leading edge 100 of the load carrying section 16 extends in a line that extends forward (towards the mouth) from the primary side fastener or pin of the load carrying section 16. This design change yields an additional volume of load carrying space 22 in the bucket 10.

Other than this design difference, the other dimensions of the bucket are basically the same as those on the bucket in FIGS. 9 and 10. Specifically, the handling section 12 is the same in all respects in the buckets of FIGS. 9 to 11, as is the position and arrangement of the mounting arrangement on the load carrying section. Therefore, the same mounting formation on the handling section 12 is used for the different sizes of load carrying sections 16.

In use, a mine operator using the bucket shown in FIG. 9 can swap out the load carrying section 16 of the bucket 10 with that shown in FIG. 11, and effectively substantially increase the volumetric load carrying capacity of the bucket 10. Thus, a single handling section 12 with a single mechanical fastening arrangement can be utilized to provide a bucket with a range of different volumes. In the illustrated embodiment, the volume of the bucket is increased by 20-25%. However, in other embodiments, greater increases could quite easily be achieved.

In some situations, the bucket 10 may be able to remain operatively connected to the loader while the load carrying sections are swapped out. This is obviously advantageous for a mine operator because the sections can be swapped out more quickly with less downtime. Additionally, less manpower and equipment are required when the load carrying section can be replaced without removing the bucket from the loader.

An advantage of the embodiments described above with reference to FIGS. 9 to 11 is that the standardization of a single handling section for different sizes of bucket can help to achieve production efficiencies. A standard jig can be provided for high tolerance manufacture which greatly reduces assembly time frames. Further, one can obtain better utilization of robotic welding processes with minimal programming input when there is a single standard size of handling section to manufacture.

The embodiment in FIGS. 9 to 11 also gives a contractor an option to swap out load carrying sections and adjust the volumetric capacity of the bucket 10 to suit an application for which the bucket is being used. Some example scenarios in which this might occur are set out below.

One scenario where a mine operator desires to increase the bucket capacity is where a substantial amount of lighter overburden is required to be removed before the ore material can be reached and recovered. A larger bucket capacity will be preferred for removing overburden because the overburden is lighter and therefore a bigger volume of material can be carried in each bucket. This can be accomplished by swapping out a smaller load carrying section for a larger load carrying section in the manner described above.

In another scenario, a mining contractor may operate a fleet of wheel loaders which need to be relocated and deployed at another mine site, where the density of the ore being recovered is different. Alternatively, the density of an ore being recovered at a particular site may change and the contractor wants to adjust the bucket size in response to different material densities to optimize their mining operation. The interchangeability of different sized load carrying sections on a single size of handling section, makes the bucket more versatile and capable of being adapted to provide different load carrying volumes. Margins are often tight, and sub-optimum bucket sizes lead to inefficient loading and lost production. The contractors are paid per ton of material removed and therefore like to optimize their bucket size.

In another scenario, a customer may be working on a new mine site with limited information of the ore body and still be trying to establish an optimum load carrying volume of the bucket. In this situation, the properties of the ore and rock material to be handled are not precisely known until operations have been conducted for some time (long after the bucket has been fabricated). In this scenario, the bucket in FIGS. 9 to 11 provides the flexibility to adapt and optimize the load carrying volume of the bucket at a later stage by replacing the load carrying section with a section that changes the volume of the bucket to provide the correct overall load carrying volume. Applicant is aware that incorrectly specified bucket volumes can lead to production targets not being met. In some extreme cases, where the fabricated bucket volume is too far away from optimal, completely new single piece buckets might need to be fabricated which is extremely wasteful and costly.

Related to this, a mining company may have multiple mining leases and its own fleet of wheel loaders for each lease, with the buckets sized to suit their specific operating conditions. However, when a lease expires, or is put on care and maintenance, or production is ramped up at other locations, loaders may need to be transferred between sites. The existing loaders may have bucket sizes that are sub-optimal for the new site and this feature enables the volume of the bucket to be changed to suit the current situation.

It will of course be realized that the above has been given only by way of illustrative example of the invention and that all such modifications and variations thereto, as would be apparent to persons skilled in the art, are deemed to fall within the broad scope and ambit of the invention as is herein set forth.

The invention claimed is:

1. A bucket for a loader, the bucket comprising:

a handling section connected to a separate load carrying section to form a fixed body, the handling and load carrying sections defining a load carrying space and an open mouth through which material is received into and discharged from the load carrying space, the handling section including an upper wall that extends rearward in a direction away from the open mouth, and the load carrying section including a base wall and two side walls projecting up from each side of the base wall;

a primary side fastening arrangement fastening each side wall of the load carrying section to the upper wall of the handling section, the primary side fastening arrangement mounting the load carrying section on the handling section while permitting the handling section to pivot relative to the load carrying section; and a secondary end fastening arrangement that is different to the primary side fastening arrangement and that fastens the upper wall to the base wall;

wherein during replacement of the load carrying section, the handling section is configured to be mounted on the load carrying section and pivoted into an assembly position, and the handling and load carrying sections are configured for a rear end of the upper wall to slide over a rear end of the base wall.

2. The bucket for a loader according to claim 1, wherein the handling section includes a mounting formation, and the load carrying section includes a complementary mounting formation interacting with the mounting formation of the handling section.

3. The bucket for a loader according to claim 2, wherein the load carrying section is sized and configured to be received within the mounting formation of the handling section.

4. The bucket for a loader according to claim 2, wherein the mounting formation of the handling section includes locating tabs on each side of the upper wall that locates the load carrying section on the handling section in a lateral direction.

5. The bucket for a loader according to claim 2, wherein the mounting formation of the handling section further includes locating tabs on the upper wall for locating the load carrying section on the handling section in a front to rear direction.

6. The bucket for a loader according to claim 1, wherein the secondary end fastening arrangement includes a plurality of mechanical fasteners that fasten the upper wall to the base wall.

7. The bucket for a loader according to claim 6, wherein the plurality of mechanical fasteners is arranged in a line from one side of the upper wall to the other side.

8. The bucket for a loader according to claim 1, wherein the secondary end fastening arrangement includes at least one weld for welding the rear end of the upper wall to the base wall.

9. The bucket for a loader according to claim 1, wherein the mouth has a width extending from one side wall to the other side wall and a height extending from the base wall to the upper wall at the mouth, and the width of the mouth is greater than the height of the mouth, and wherein the width of the mouth is at least 50% greater than the height of the mouth.

10. The bucket for a loader according to claim 1, wherein the primary side fastening arrangement is configured to correctly position the handling section relative to the load carrying section in a lateral direction, and comprises a primary fastener on each side of the fixed body connecting the side wall to the upper wall that permits the handling section to pivot relative to the load carrying section.

11. The bucket for a loader according to claim 10, wherein the primary side fastening arrangement comprises a boss formation on each side of the load carrying section forming a fastener aperture, and a further boss formation on each side of the handling section forming a further fastener aperture, and wherein said one and further fastener apertures on each side are aligned with each other to receive the primary fastener therethrough.

12. The bucket for a loader according to claim 10, wherein each primary fastener includes a pin.

13. A method of changing the size of a bucket for a loader comprising a handling section that is connected to a separate load carrying section to form a fixed body defining a load carrying space and an open mouth through which material is received into and discharged from the load carrying space, the handling section including an upper wall that extends in a direction away from the open mouth, and the load carrying section including a base wall and two side walls projecting up from each side of the base wall, a primary side fastening arrangement fastening each side wall of the load carrying section to the upper wall of the handling section, the primary side fastening arrangement mounting the load carrying section on the handling section while permitting the handling section to pivot relative to the load carrying section, and a secondary end fastening arrangement that is different to the primary side fastening arrangement and that fastens the upper wall to the base wall, the method comprising:

separating said one load carrying section from the handling section by removing the secondary end fastening arrangement to detach the upper wall from the base wall, and then removing the primary side fastening arrangement to detach the side walls from the upper wall, bringing another load carrying section of different size to said one load carrying section into position adjacent to said one handling section;

mounting said one handling section on the other load carrying section by means of the primary side fastening arrangement so that the handling section is supported on the other load carrying section;

pivoting the handling section into an assembly position on the other load carrying section by sliding a rear end of the upper wall over a rear end of the base wall; and then fastening the upper wall to the base wall of the other load carrying section with the secondary end fastening arrangement to form a reconfigured bucket having a different volume of load carrying space.

14. The method of changing the size of a bucket for a loader according to claim 13, wherein the handling section includes a mounting formation and the load carrying section includes a complementary mounting formation interacting with said one mounting formation and said complementary mounting formations of each of said one and other load carrying sections are sized and configured so that they both fit on said one mounting formation on the handling section.

15. The method of changing the size of a bucket for a loader according to claim 13, wherein the bucket body has a depth in a direction from a front end to the rear end of the upper wall, and changing the load carrying section increases or decreases the depth of the bucket body which increases or decreases the volume of the load carrying space.

16. The method of changing the size of a bucket a loader according to claim 13, wherein the primary side fastening arrangement includes a boss formation on each side of the load carrying section forming a fastener aperture, and a further boss formation on each side of the handling section forming a further fastener aperture, and said one and further fastener apertures on each side are aligned with each other to receive the primary fastener therethrough.

17. The method of changing the size of a bucket for a loader according to claim 13, wherein the primary side fastening arrangement is configured to correctly position the handling section relative to the load carrying section in a lateral direction, and the primary side fastening arrangement comprises a primary fastener including a pin on each side of the body connecting the side wall to the upper wall that permits the handling section to pivot relative to the load carrying section.

18. A method of refurbishing a bucket for a loader comprising a handling section that is connected to a separate load carrying section to form a fixed body defining a load carrying space and an open mouth through which material is received into and discharged from the load carrying space, the handling section including an upper wall that extends rearward in a direction away from the open mouth, and the load carrying section including a base wall and two side walls projecting up from each side of the base wall, a primary side fastening arrangement fastening each side wall of the load carrying section to the upper wall of the handling section, the primary side fastening arrangement mounting the load carrying section on the handling section while permitting the handling section to pivot relative to the load carrying section, wherein the handling and load carrying sections are configured for a rear end of the upper wall to slide over a rear end of the base wall while the load carrying section is pivotally mounted on the handling section, and a secondary end fastening arrangement that is different to the primary side fastening arrangement and that fastens the upper wall to the base wall, the method comprising:

separating said one load carrying section from the handling section by removing the secondary end fastening arrangement to detach the upper wall from the base wall, and then removing the primary side fastening arrangement to detach the side walls from the upper wall and separate the handling and load carrying sections;

bringing another load carrying section into position adjacent to said one handling section;

mounting said one handling section on the other load carrying section by means of the primary side fastening arrangement so that the handling section is supported on the other load carrying section;

pivoting the handling section into an assembly position on the other load carrying section by sliding the rear end of the upper wall over the rear end of the base wall; and then fastening the upper wall to the base wall with the secondary end fastening arrangement to form a refurbished bucket.

19. The method of refurbishing a bucket according to claim 18, wherein said removing the fastening arrangement includes cutting or unfastening mechanical fasteners from the handling and load carrying sections and fastening said other load carrying section to said one handling section with the fastening arrangement includes fastening the side walls to the upper wall with mechanical fasteners and fastening the rear end of the upper wall to the base wall with mechanical fasteners; or wherein said removing the fastening arrangement includes cutting welds fastening the handling and load carrying sections to each other, and wherein fastening said other load carrying section to said one handling section includes welding the side walls to the upper wall and welding the rear end of the upper wall to the base wall.

20. The method of refurbishing a bucket according to claim 18, wherein the primary side fastening arrangement is configured to correctly position the handling section relative to the load carrying section in a lateral direction, and the primary side fastening arrangement comprises a primary fastener including a pin on each side of the body connecting the side wall to the upper wall that permits the handling section to pivot relative to the load carrying section.

* * * * *